US010066610B2

(12) United States Patent
Yamada et al.

(10) Patent No.: US 10,066,610 B2
(45) Date of Patent: Sep. 4, 2018

(54) TILTING ANGLE CONTROL DEVICE

(71) Applicant: KAWASAKI JUKOGYO KABUSHIKI KAISHA, Kobe-shi, Hyogo (JP)

(72) Inventors: Masahiro Yamada, Kobe (JP); Hideyasu Muraoka, Akashi (JP); Kazuto Fujiyama, Kobe (JP); Ryo Yamamoto, Kobe (JP)

(73) Assignee: KAWASAKI JUKOGYO KABUSHIKI KAISHA, Kobe-shi (JP)

( * ) Notice: Subject to any disclaimer, the term of this patent is extended or adjusted under 35 U.S.C. 154(b) by 846 days.

(21) Appl. No.: 14/414,286

(22) PCT Filed: Jul. 8, 2013

(86) PCT No.: PCT/JP2013/004211

§ 371 (c)(1),
(2) Date: Jan. 12, 2015

(87) PCT Pub. No.: WO2014/010222

PCT Pub. Date: Jan. 16, 2014

(65) Prior Publication Data

US 2015/0211501 A1 Jul. 30, 2015

(30) Foreign Application Priority Data

Jul. 10, 2012 (JP) ..... 2012-154610

(51) Int. Cl.
*E02F 9/00* (2006.01)
*F04B 1/29* (2006.01)
(Continued)

(52) U.S. Cl.
CPC ..... *F04B 1/295* (2013.01); *E02F 9/2235* (2013.01); *E02F 9/2282* (2013.01);
(Continued)

(58) Field of Classification Search
None
See application file for complete search history.

(56) References Cited

U.S. PATENT DOCUMENTS 4,745,746 A * 5/1988 Geringer ..... F16D 31/08 417/216
5,421,155 A 6/1995 Hirata et al.
(Continued)

FOREIGN PATENT DOCUMENTS

JP H0446202 A 2/1992
JP H08121344 A 5/1996
(Continued)

OTHER PUBLICATIONS

May 20, 2016 Extended Search Report issued in European Patent Application No. 13816544.4.
(Continued)

*Primary Examiner* — Ronald D Hartman, Jr.
(74) *Attorney, Agent, or Firm* — Oliff PLC

(57) ABSTRACT

A tilting angle control device includes pressure sensors. Each of the pressure sensors outputs to a control unit a pressure command signal corresponding to an operation amount. The control unit outputs to an electromagnetic proportional control valve a pressure control signal corresponding to the pressure command signal, and the electromagnetic proportional control valve outputs to a tilt adjustment mechanism pilot pressure corresponding to the pressure control signal. The tilt adjustment mechanism adjusts a tilting angle of a variable displacement pump such that the tilting angle becomes an angle corresponding to the pilot pressure. A pilot pressure sensor detects the pilot pressure to output a pressure feedback signal to the control unit. The control unit calculates the pressure control signal based on the pressure feedback signal and the pressure command signal and performs feedback control of the pilot pressure.

9 Claims, 10 Drawing Sheets

(51) Int. Cl.

| | |
|---|---|
| ***F04B 49/06*** | (2006.01) |
| ***E02F 9/22*** | (2006.01) |
| ***F15B 11/16*** | (2006.01) |
| ***F04B 1/12*** | (2006.01) |
| ***F04B 1/14*** | (2006.01) |

(52) U.S. Cl.

CPC ..... *E02F 9/2292* (2013.01); *E02F 9/2296* (2013.01); *F04B 1/122* (2013.01); *F04B 1/146* (2013.01); *F04B 49/06* (2013.01); *F15B 11/165* (2013.01); *F15B 11/167* (2013.01); *F15B 2211/20553* (2013.01); *F15B 2211/20576* (2013.01); *F15B 2211/6316* (2013.01); *F15B 2211/6355* (2013.01); *F15B 2211/6652* (2013.01)

(56) References Cited

U.S. PATENT DOCUMENTS

| | | | | |
|---|---|---|---|---|
| 6,098,322 | A * | 8/2000 | Tozawa | E02F 3/437 37/414 |
| 6,108,948 | A * | 8/2000 | Tozawa | E02F 3/435 172/2 |
| 7,007,466 | B2 * | 3/2006 | Price | F15B 11/08 60/431 |
| 8,812,202 | B2 * | 8/2014 | Yamamoto | E02F 9/123 303/112 |
| 2003/0115866 | A1 * | 6/2003 | Price | F15B 11/08 60/431 |
| 2007/0193263 | A1 | 8/2007 | Otaka et al. | |
| 2013/0332036 | A1 * | 12/2013 | Yamamoto | E02F 9/123 701/50 |

FOREIGN PATENT DOCUMENTS

| | | | |
|---|---|---|---|
| JP | H0988902 | A | 3/1997 |
| JP | H11311203 | A | 11/1999 |
| WO | 2005100793 | A1 | 10/2005 |

OTHER PUBLICATIONS

Sep. 17, 2013 International Search Report issued in International Application No. PCT/JP2013/004211.

* cited by examiner

TILTING ANGLE CONTROL DEVICE

TECHNICAL FIELD

The present invention relates to a tilting angle control device configured to control a tilting angle of a variable displacement pump configured to change a discharge amount of a pressure liquid in accordance with the tilting angle.

BACKGROUND ART

A construction machine, such as a hydraulic excavator, includes a plurality of hydraulic actuators and can drive the hydraulic actuators to move various components, such as booms, arms, buckets, swivel devices, and travel devices, thereby performing various work, and the like. The plurality of actuators are connected to a variable displacement pump and are driven by a pressure liquid discharged from the variable displacement pump. The variable displacement pump is, for example, a swash plate pump or a bent axis pump and can change the tilting angle of a swash plate or axis to change a discharge flow rate of the pressure liquid. The variable displacement pump is provided with a tilting angle control device configured to adjust the tilting angle in accordance with the operation amount of an operation lever of the tilting angle control device.

When the operation amount of the operation lever of the tilting angle control device is maximized, the variable displacement pump discharges the pressure liquid, the discharge flow rate of which is maximum. It is preferable that the maximum discharge flow rate of the variable displacement pump be set so as not to exceed an allowable maximum flow rate of each of all the hydraulic actuators. However, there is a case where a high flow rate variable displacement pump is provided so as to correspond to the hydraulic actuator having the highest allowable maximum flow rate. In this case, the discharge flow rate of the variable displacement pump needs to be controlled accurately in accordance with each of the allowable maximum flow rates of the hydraulic actuators.

The travel devices are separately arranged at both left and right sides of a car body and respectively include separate hydraulic motors. The hydraulic motors are respectively supplied with the pressure liquid from separate variable displacement pumps. The straight running stability deteriorates if the discharge flow rates of the two variable displacement pumps are not accurately controlled.

For example, according to the hydraulic excavator, the flow rates respectively required by the hydraulic actuators differ from one another depending on work conditions, such as excavating work and swiveling work. Therefore, it is desirable that the variable displacement pump discharge the pressure liquid, the flow rate of which is required depending on each work condition of the hydraulic excavator. In this case, the discharge flow rate of the pressure fluid discharged from the variable displacement pump needs to be accurately controlled by the tilting angle control device.

As above, the control accuracy of the tilting angle control device is demanded, and as devices each of which satisfies this demand of the control accuracy, for example, tilt control devices described in PTLs 1 and 2 are known.

The tilting angle control device described in PTL 1 includes a hydraulic regulator (tilt adjustment mechanism) and adjusts the tilting angle of the variable displacement pump in such a manner that a control unit of the tilting angle control device drives the hydraulic regulator. The control unit controls the regulator based on a command value and actual measurement value of the tilting angle and the discharge pressure of the variable displacement pump. According to the tilting angle control device described in PTL 2, the control unit adjusts the tilting angle of the variable displacement pump based also on the temperature of the operating oil.

CITATION LIST

Patent Literature

PTL 1: Japanese Laid-Open Patent Application Publication No. 9-88902

PTL 2: Japanese Laid-Open Patent Application Publication No. 8-121344

SUMMARY OF INVENTION

Technical Problem

The tilting angle control device may include a pilot type tilt adjustment mechanism. The tilting angle control device including the tilt adjustment mechanism includes an electromagnetic proportional control valve. A pilot type tilt control device causes the electromagnetic proportional control valve to output the pilot pressure, corresponding to the operation amount of the operation lever, to the tilt adjustment mechanism, and the tilt adjustment mechanism adjusts the discharge amount of the variable displacement pump in accordance with this pilot pressure, that is, the tilt adjustment mechanism adjusts the discharge amount of the variable displacement pump in accordance with the operation amount of the operation lever. According to the pilot type tilting angle control device configured as above, the control accuracy of the discharge amount is limited due to influences of, for example, the individual variability of the performance of the electromagnetic proportional control valve.

Here, an object of the present invention is to provide a tilting angle control device capable of further improving the control accuracy and control responsiveness of the discharge amount of the variable displacement pump, that is, the control accuracy and control responsiveness of the tilting angle of the variable displacement pump.

Solution to Problem

A tilt control device of the present invention is a tilting angle control device configured to control a tilting angle of a variable displacement pump configured to discharge a pressure liquid, the amount of which corresponds to the tilting angle, the tilting angle control device including: an operation unit configured to output a pressure command signal corresponding to an operation amount of the operation unit, in order to drive an actuator; a control unit configured to output a pressure control signal corresponding to the pressure command signal; a proportional control valve configured to output pilot pressure corresponding to the pressure control signal; a tilt adjustment mechanism configured to adjust the tilting angle of the variable displacement pump such that the tilting angle becomes an angle corresponding to the pilot pressure; and a pressure detector configured to detect the pilot pressure to output to the control unit a pressure feedback signal corresponding to the detected pilot pressure, wherein the control unit calculates the pressure control signal based on the pressure feedback signal and the pressure command signal.

According to the present invention, by the control unit, the proportional control valve, and the tilt adjustment mechanism, the tilting angle can be adjusted to become an angle corresponding to the operation amount of the operation unit, and the operating oil, the discharge amount of which corresponds to the operation amount, can be discharged from the variable displacement pump. Specifically, in the present invention, the pressure detector detects the pilot pressure, and the control unit performs feedback control of the pilot pressure by the pressure feedback signal corresponding to the detected pilot pressure. Therefore, the control accuracy and responsiveness of the pilot pressure output in accordance with the pressure command signal can be improved. With this, the tilting angle can be accurately, quickly adjusted in accordance with the operation amount of the operation unit. Thus, the discharge liquid from the variable displacement pump can be controlled accurately and quickly in accordance with the operation amount.

In the above invention, the proportional control valve has a valve characteristic of outputting predetermined pilot pressure corresponding to the pressure control signal input to the proportional control valve, and the control unit stores the valve characteristic and calculates the pressure control signal based on the pressure feedback signal, the pressure command signal, and the valve characteristic.

According to the above configuration, influences of, for example, the individual variability of the performance of the proportional control valve can be eliminated, and the accuracy of the pilot pressure can be improved.

In the above invention, it is preferable that the control unit include: an output characteristics calculation unit configured to store an output characteristic indicating the pilot pressure to be output from the proportional control valve in accordance with the pressure command signal and configured to calculate an output pressure signal based on the pressure command signal from the operation unit and the output characteristic; and a feedback control portion configured to calculate the pressure control signal based on the valve characteristic, the feedback signal, and the output pressure signal.

According to the above configuration, the output characteristics calculation unit stores the output characteristic that is a relationship between the input signal to the proportional control valve and the output pressure (pilot pressure) from the proportional control valve. Therefore, the output pressure (pilot pressure) from the proportional control valve can be suitably set such that, for example, even in a case where the input signal to the proportional control valve is a maximum value, the discharge amount of the hydraulic pump becomes equal to or lower than an allowable maximum flow rate of a hydraulic actuator. With this, the operating oil, the flow rate of which is higher than the allowable maximum flow rate, can be prevented from being introduced to the hydraulic actuator.

In the above invention, it is preferable that the feedback control portion include: a valve characteristics calculation unit configured to calculate a first current value based on the valve characteristic and the output pressure signal; a control calculation unit configured to perform control calculation of a deviation between the first current value and the pressure feedback signal to obtain a control calculation value; and an addition calculation unit configured to add the first current value and the control calculation value to obtain the pressure control signal and output the pressure control signal to the proportional control valve.

According to the above configuration, the influences of, for example, the individual variability of the performance of the proportional control valve can be eliminated, and the accuracy of the pilot pressure can be improved. With this, for example, the operating oil, the flow rate of which is the maximum flow rate within a range of the allowable maximum flow rate of the actuator, can be supplied from the variable displacement pump to the actuator, so that the actuator can be operated at a maximum speed, and the actuator can be prevented from being damaged by the excessive flow rate. In addition, since the response delay of the proportional control valve can be corrected, the responsiveness of the pilot pressure can also be improved.

In the above invention, it is preferable that the feedback control portion include: a valve characteristics calculation unit configured to calculate a first current value based on the valve characteristic and the output pressure signal; a valve characteristics calculation unit configured to calculate a second current value based on the valve characteristic and the pressure feedback signal; a control calculation unit configured to perform control calculation of a deviation between the first current value and the second current value to obtain a control calculation value; and an addition calculation unit configured to add the first current value and the control calculation value to obtain the pressure control signal and output the pressure control signal to the proportional control valve.

According to the above configuration, the influences of, for example, the individual variability of the performance of the proportional control valve can be eliminated, and the accuracy of the pilot pressure can be improved. With this, for example, the operating oil, the flow rate of which is the maximum flow rate within a range of the allowable maximum flow rate of the actuator, can be supplied from the variable displacement pump to the actuator, so that the actuator can be operated at a maximum speed, and the actuator can be prevented from being damaged by the excessive flow rate. In addition, since the response delay of the proportional control valve can be corrected, the responsiveness of the pilot pressure can also be improved.

In the above invention, it is preferable that the feedback control portion include: a control calculation unit configured to perform control calculation of a deviation between the output pressure signal and the pressure feedback signal to obtain a control calculation value; an addition calculation unit configured to add the output pressure signal and the control calculation value to obtain an addition calculation value; and a valve characteristics calculation unit configured to calculate the pressure control signal based on the valve characteristic and the addition calculation value and output the pressure control signal to the proportional control valve.

According to the above configuration, the influences of, for example, the individual variability of the performance of the proportional control valve can be eliminated, and the accuracy of the pilot pressure can be improved. With this, for example, the operating oil, the flow rate of which is the maximum flow rate within a range of the allowable maximum flow rate of the actuator, can be supplied from the variable displacement pump to the actuator, so that the actuator can be operated at a maximum speed, and the actuator can be prevented from being damaged by the excessive flow rate. In addition, since the response delay of the proportional control valve can be corrected, the responsiveness of the pilot pressure can also be improved.

In the above invention, it is preferable that: the operation unit be one of a plurality of operation units respectively provided for a plurality of actuators; and the control unit include the output characteristics calculation unit provided for each of the operation units, and a selector configured to select the output pressure signal by which a discharge flow rate of the variable displacement pump becomes the highest, out of a plurality of output pressure signals calculated by the output characteristics calculation units.

According to the above configuration, the feedback control can be performed based on the output pressure signal by which the discharge flow rate becomes the highest. With this, each of all the actuators operated can operate at a speed corresponding to the operation amount. In addition, the output characteristics calculation units are respectively provided for the operation units. Therefore, in a case where each actuator is independently operated, the operating oil, the flow rate of which is most appropriate for each actuator, can be supplied from the variable displacement pump.

In the above invention, it is preferable that: the tilting angle control device use a negative control method; and the proportional control valve be an inverse proportional valve.

According to the above configuration, in a case where power cannot be supplied to the proportional control valve due to, for example, the malfunction of an electric system, the maximum pressure is output, and the pump tilt becomes minimum, that is, the flow rate becomes minimum. On this account, the actuator speed decreases. Thus, the fail-safe can be realized.

In the above invention, it is preferable that: the tilting angle control device use a positive control method; and the proportional control valve be a direct proportional valve.

According to the above configuration, in a case where power cannot be supplied to the proportional control valve due to, for example, the malfunction of an electric system, the minimum pressure is output, and the pump tilt becomes minimum, that is, the flow rate becomes minimum. On this account, the actuator speed decreases. Thus, the fail-safe can be realized.

In the above invention, it is preferable that: the operation unit be one of a plurality of operation units respectively provided for a plurality of actuators; and the control unit include the output characteristics calculation unit provided for each of the operation units, and a selector configured to select the output pressure signal by which a discharge flow rate of the variable displacement pump becomes the highest, out of a plurality of output pressure signals calculated by the output characteristics calculation units.

According to the above configuration, the feedback control can be performed based on the output pressure signal by which the discharge flow rate becomes the highest. With this, each of all the actuators operated can operate at a speed corresponding to the operation amount. In addition, the output characteristics calculation units are respectively provided for the operation units. Therefore, in a case where each actuator is independently operated, the operating oil, the flow rate of which is most appropriate for each actuator, can be supplied from the variable displacement pump.

In the above invention, the tilting angle control device is configured such that: the tilting angle control device uses a negative control method; the tilting angle control device further comprises control valves each configured to operate in accordance with an operation of the operation unit to control a flow rate of the pressure liquid flowing to the actuator; the operation unit is one of a plurality of operation units respectively provided for a plurality of actuators; spools of the control valves are respectively provided for the plurality of actuators; the control unit includes the output characteristics calculation unit provided for each of the operation units, a selector configured to select the output pressure signal by which a discharge amount of the variable displacement pump becomes the largest, out of a plurality of output pressure signals calculated by the output characteristics calculation units, and a selective mechanism configured to select, based on the output pressure signal selected by the selector, pressure by which the discharge amount of the variable displacement pump becomes small, out of the pilot pressure output from the proportional control valve and negative control pressure at a negative control passage branching from an extreme downstream of the spool of the control valve; and the tilt adjustment mechanism adjusts the tilting angle of the variable displacement pump such that the tilting angle becomes an angle corresponding to the pressure selected by the selective mechanism.

According to the above configuration, in a case where each actuator is independently operated, the pilot pressure is output from the proportional control valve such that the operating oil, the flow rate of which is most appropriate for each actuator, is supplied from the variable displacement pump by the output characteristics calculation units respectively provided for the operation units. In a case where the movement distance of the spool does not correspond to the operation amount of the operation unit due to combined operations or disturbances, such as flow force acting on the spool, the negative control pressure changes in accordance with the movement distance of the spool. At this time, the pressure by which the discharge amount becomes small is selected, so that the supply of the operating oil to the actuator at the excessive flow rate can be prevented. Thus, the energy saving property improves. In addition, the control by the control unit may be applied to only a part of the operation units.

Advantageous Effects of Invention

The present invention can improve the control accuracy and responsiveness of the discharge flow rate of the variable displacement pump, that is, the control accuracy and responsiveness of the tilting angle of the variable displacement pump.

The above object, other objects, features, and advantages of the present invention will be made clear by the following detailed explanation of preferred embodiments with reference to the attached drawings.

DESCRIPTION OF EMBODIMENTS

Hereinafter, the configurations of tilting angle control devices 1, 1A, and 1B according to Embodiments 1 to 3 of the present invention and the configuration of a hydraulic drive system 2 including the tilting angle control device 1, 1A, or 1B will be explained in reference to the drawings. The concept of directions in the embodiments is used for convenience of explanation and does not indicate that the arrangements, directions, and the like of components of the tilting angle control devices 1, 1A, and 1B and the hydraulic drive system 2 are limited to the directions. Each of the structures of the tilting angle control devices 1, 1A, and 1B and the hydraulic drive system 2 explained below is just one embodiment of the present invention, and the present invention is not limited to the embodiments. Additions, deletions, and modifications may be made within the scope of the present invention.

Hydraulic Drive System

Figure 1:
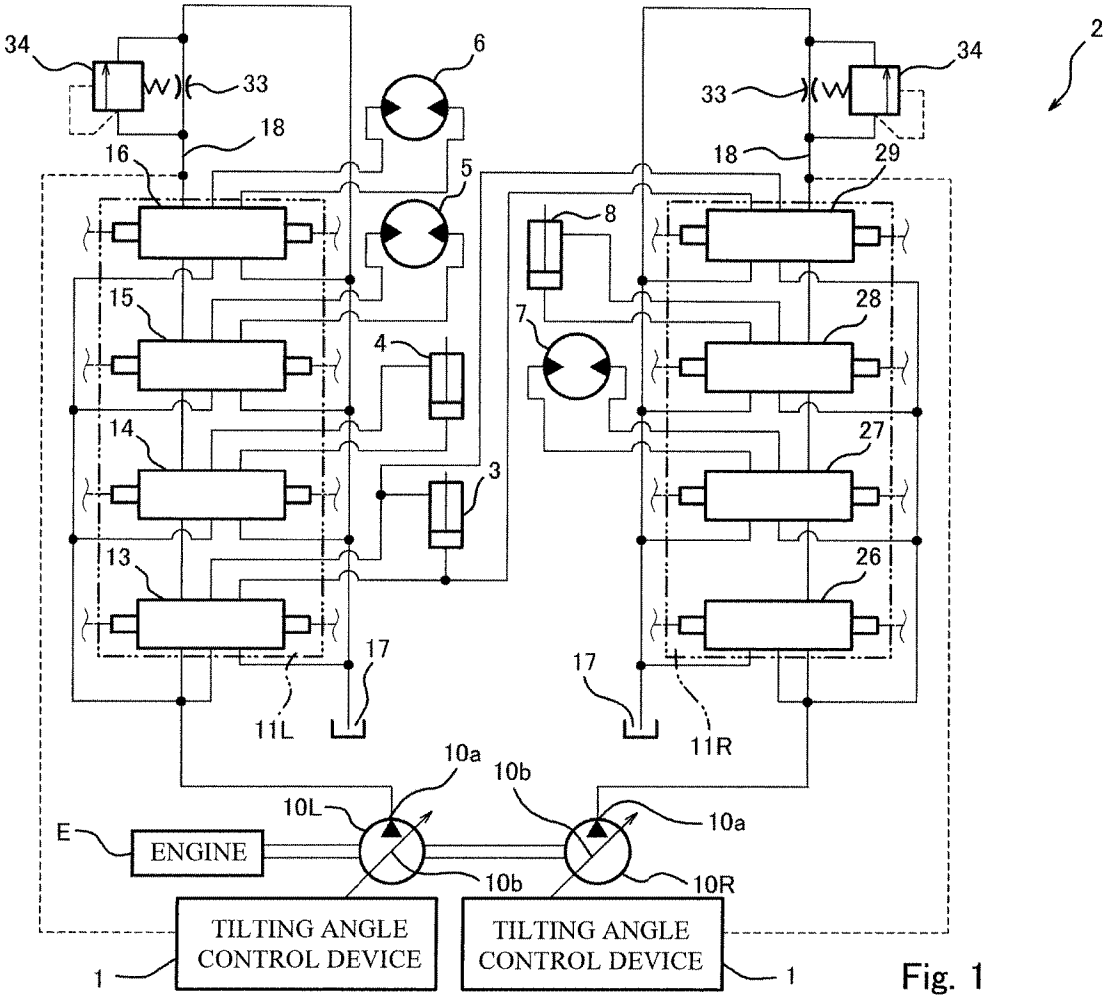
FIG. 1 is a hydraulic circuit diagram of a hydraulic drive system including a tilting angle control device according to Embodiment 1 of the present invention.

A construction machine, such as a hydraulic excavator, includes actuators for booms, arms, buckets, swivel devices, travel devices, and the like, and drives these actuators to perform various work. These actuators are constituted by hydraulic devices, such as a cylinder mechanism and a hydraulic motor, and are driven by the hydraulic drive system 2 shown in FIG. 1. The hydraulic drive system 2 includes two hydraulic pumps 10L and 10R.

The hydraulic pumps 10L and 10R are driven by an engine E. Each of the hydraulic pumps 10L and 10R discharges operating oil from an outlet port 10*a*. Multi-control valves 11L and 11R are respectively connected to the outlet ports 10*a* of the hydraulic pumps 10L and 10R, and the hydraulic pumps 10L and 10R respectively supply the pressure liquid to the multi-control valves 11L and 11R. A configuration located downstream of the hydraulic pump 10L and a configuration located downstream of the hydraulic pump 10R are basically the same as each other except for hydraulic actuators 3 to 9 to be driven. Therefore, the following will mainly explain only the configuration connected to the hydraulic pump 10L. Regarding the configuration connected to the hydraulic pump 10R, only the points different from the configuration connected to the hydraulic pump 10L will be explained. The same reference signs are used for the same components, and a repetition of the same explanation is avoided.

The multi-control valve 11L is configured by integrating a plurality of control valves. In the present embodiment, four control valves 13 to 16 are integrated. These four control valves 13 to 16 are connected in parallel to the hydraulic pump 10L, and the operating oil is supplied from the hydraulic pump 10L separately to the control valves 13 to 16. These four control valves 13 to 16 are, for example, a boom merging control valve 13, an arm control valve 14, a left travel device control valve 15, and a swivel control valve 16 and are respectively connected to a boom cylinder 3, an arm cylinder 4, a left travel motor 5, and a swivel motor 6. These four control valves 13 to 16 are also connected to a tank 17. Four control valves 26 to 29 connected to the hydraulic pump 10R are, for example, a preliminary control valve 26, a right travel device control valve 27, a bucket control valve 28, and a boom control valve 29, which are arranged in this order from an upstream side. The control valves 26 to 29 are connected to a right travel motor 7, a bucket cylinder 8, and the boom cylinder 3.

Each of the control valves 13 to 16 connected as above is a so-called normally open valve and includes a spool, not shown. When the spools of the control valves 13 to 16 are respectively located at neutral positions, the control valves 13 to 16 form a tank passage 18 that connects the hydraulic pump 10L and the tank 17. The operating oil from the hydraulic pump 10L flows through the tank passage 18 to be discharged to the tank 17. The control valves 13 to 16 are serially lined up in this order at the tank passage 18. When the spool of any one of the control valves 13 to 16 is moved from the neutral position, the tank passage 18 is blocked by the spool. When any one of the spools is moved, the operating oil, the flow rate of which corresponds to the position of the moved spool, is supplied to the hydraulic actuator 3, 4, 5, or 6 corresponding to the moved spool. Thus, the hydraulic actuator 3, 4, 5, or 6 is driven.

Figure 2:
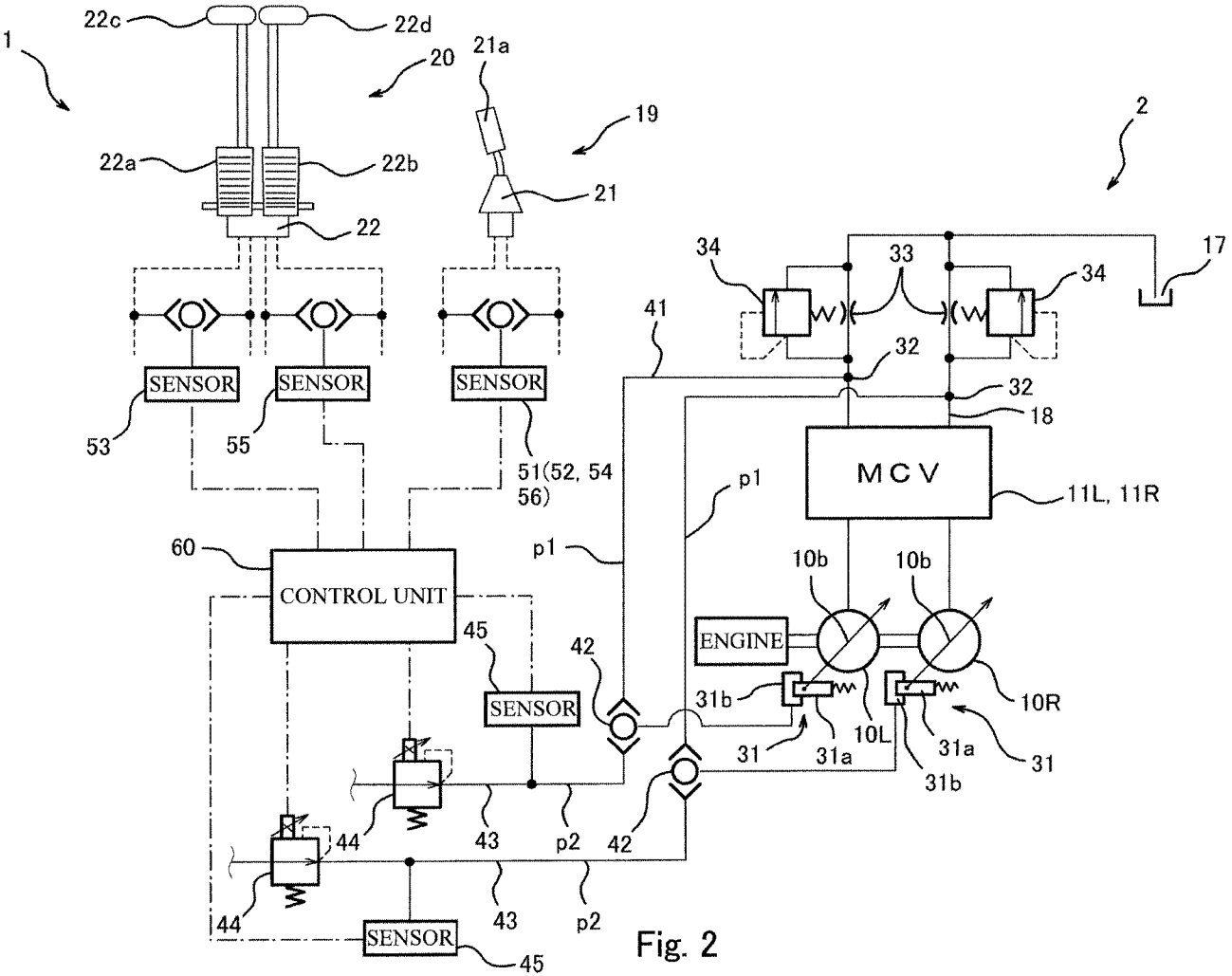
FIG. 2 is a hydraulic circuit diagram showing the configuration of the tilting angle control device of FIG. 1.

Operation valves 21 and 22 shown in FIG. 2 are connected to the control valves 13 to 16 configured as above. FIG. 2 shows only two operation valves 21 and 22. However, in fact, one operation valve is provided for each of the control valves 13 to 16. A work operation valve 21 (hereinafter may be simply referred to as the "operation valve 21") is a so-called remote control valve and is provided with an operation lever 21*a*. The operation lever 21*a* is configured to be swingable in a predetermined direction (for example, a front-rear direction or a left-right direction) from the neutral position. The operation valve 21 causes the pilot pressure, corresponding to an operation amount of the operation lever 21*a*, to flow in a direction corresponding to an operation direction of the operation lever 21*a*.

The operation valve 21 is connected to, for example, the boom merging control valve 13, the arm control valve 14, or the swivel control valve 16, and supplies the pilot pressure, corresponding to the operation amount of the operation lever 21*a*, to the spool of the valve 13, 14, or 16. The spool that has received the pilot pressure moves from the neutral position to a position corresponding to the pilot pressure. With this, the hydraulic actuator 3, 4, or 6 is supplied with the operating oil, the amount of which corresponds to the operation amount of the operation lever 21*a*. Thus, the hydraulic actuator 3, 4, or 6 moves at a speed corresponding to the operation amount of the operation lever 21*a*.

A travel operation valve 22 (hereinafter may be simply referred to as the "operation valve 22") is a so-called remote control valve and includes a pair of left and right operation pedals 22*a* and 22*b*. These operation pedals 22*a* and 22*b* can be operated to swing in the front-rear direction. The operation pedals 22*a* and 22*b* are respectively provided with travel levers 22*c* and 22*d*. The operation pedals 22*a* and 22*b* can be respectively operated also by the travel levers 22*c* and 22*d*. The travel operation valve 22 causes the pilot pressure, corresponding to the operation amounts of the operation pedals 22*a* and 22*b*, to flow in a direction corresponding to the operation directions of the operation pedals 22*a* and 22*b*.

The travel operation valve 22 is connected to the left travel device control valve 15 and the right travel device control valve 27. When the left operation pedal 22*a* is operated, the travel operation valve 22 supplies the pilot pressure, corresponding to the operation amount of the left operation pedal 22*a*, to the spool of the left travel device control valve 15. When the right operation pedal 22*b* is operated, the travel operation valve 22 supplies the pilot pressure, corresponding to the operation amount of the right operation pedal 22*b*, to the spool of the right travel device control valve 27. The spool of each of the valves 15 and 27 moves from the neutral position to a position corresponding to the received pilot pressure. With this, the left travel motor 5 is supplied with the operating oil, the amount of which corresponds to the operation amount of the operation pedal 22*a*, and the right travel motor 7 is supplied with the operating oil, the amount of which corresponds to the operation amount of the operation pedal 22*b*. Thus, the left travel motor 5 operates at a speed corresponding to the operation amount of the operation pedal 22*a*, and the right travel motor 7 operates at a speed corresponding to the operation amount of the operation pedal 22*b*.

Each of the hydraulic pumps 10L and 10R adopted in the hydraulic drive system 2 configured as above is a variable displacement hydraulic pump, such as a swash plate pump or a bent axis pump. In the present embodiment, a swash plate pump is adopted as each of the hydraulic pumps 10L and 10R. Each of the hydraulic pumps 10L and 10R can tilt a swash plate 10*b* to change a tilting angle α of the swash plate 10*b*. Each of the hydraulic pumps 10L and 10R discharges the operating oil, the discharge amount of which corresponds to the tilting angle α. In order to adjust the tilting angle α, the hydraulic pumps 10L and 10R are respectively provided with tilting angle control devices 1.

The tilting angle control devices 1 respectively provided at the hydraulic pumps 10L and 10R are the same in configuration as each other. The following will explain only the configuration of the tilting angle control device 1 provided at the hydraulic pump 10L. Regarding the configuration of the tilting angle control device 1 provided at the hydraulic pump 10R, the same reference signs are used for the same components, and a repetition of the same explanation is avoided.

Embodiment 1

Tilting Angle Control Device

As shown in FIG. 2, the tilting angle control device 1 includes a tilt adjustment mechanism 31. The tilt adjustment mechanism 31 is a so-called servo mechanism and is provided at the hydraulic pump 10L. The tilt adjustment mechanism 31 includes a servo piston, not shown, and the servo piston is connected to the swash plate 10*b*. The servo piston moves in accordance with a movement distance of a pilot piston 31*a*. In the tilt adjustment mechanism 31, a pressure chamber 31*b* is formed at one end of the pilot piston 31*a*. When the pilot pressure is supplied to the pressure chamber 31*b*, the pilot piston 31*a* moves. With this, the servo piston moves to tilt the swash plate 10*b*. As shown in FIG. 2, the pressure chamber 31*b* of the tilt adjustment mechanism 31 is connected through a first pilot passage 41 to a connecting point 32 of the tank passage 18, the connecting point 32 being located downstream of the swivel control valve 16 (regarding the hydraulic pump 10R, the connecting point 32 being located downstream of the boom control valve 29). A restrictor 33 is formed at the tank passage 18 so as to be located downstream of the connecting point 32 (that is, located at the tank side). A relief valve 34 is provided so as to connect a portion upstream of the restrictor 33 and a portion downstream of the restrictor 33.

When the operating oil flows through the tank passage 18, the pressure at the connecting point 32 increases by the restrictor 33, and pilot pressure (hereinafter may be referred to as "negative control pressure") p1 of the first pilot passage 41 that is a negative control passage increases. When the increased negative control pressure p1 is introduced to the pressure chamber 31*b* of the tilt adjustment mechanism 31, the servo piston moves together with the pilot piston 31*a*, so that the tilting angle α of the swash plate 10*b* becomes small. Thus, the discharge amount of the hydraulic pump 10L decreases. In contrast, when the operation valve 21 or 22 of the hydraulic actuator 3, 4, 5, or 6 is operated to block the tank passage 18, the negative control pressure p1 decreases. When the decreased negative control pressure p1 is introduced to the pressure chamber 31*b* of the tilt adjustment mechanism 31, the servo piston is returned to the original position together with the pilot piston 31*a*, so that the tilting angle α of the swash plate 10*b* becomes large. Thus, the discharge amount of the hydraulic pump 10L increases. As above, in the present embodiment, the tilting angle control device 1 controls the discharge amount of the hydraulic pump 10L by a negative control method. In the negative control method, because of the reasons described below, it is desirable that an electromagnetic proportional control valve 44 be an inverse proportional valve.

In the tilting angle control device 1 configured as above, the first pilot passage 41 is connected to a second pilot passage 43, and a shuttle valve 42 is provided between the first pilot passage 41 and the second pilot passage 43. The electromagnetic proportional control valve 44 is connected through the second pilot passage 43 to the shuttle valve 42 that is a selective mechanism. The electromagnetic proportional control valve 44 outputs pilot pressure p2 corresponding to a pressure control signal input to the electromagnetic proportional control valve 44. The shuttle valve 42 selects higher pressure out of the pilot pressure p2 from the electromagnetic proportional control valve 44 and the negative control pressure p1 from the connecting point 32 and introduces the selected pilot pressure to the pressure chamber 31*b* of the tilt adjustment mechanism 31. A pilot pressure sensor 45 (pressure detector) configured to measure the pilot pressure p2 is provided at the second pilot passage 43.

Pressure sensors 51 to 56 are provided at the operation valves 21 and 22. The control valves 21 and 22 and the pressure sensors 51 to 56 constitute operation units 19 and 20. Each of these pressure sensors detect the pilot pressure, supplied to the corresponding control valve, to detect the operation amount of the corresponding operation valve, and then, outputs a pressure command signal corresponding to the detection result.

The pressure sensors 51 to 56, the pilot pressure sensor 45, and the electromagnetic proportional control valve 44 configured as above are connected to a control unit 60. The control unit 60 performs feedback control of an output (pilot pressure p2) of the electromagnetic proportional control valve 44 based on detection results (that is, the pressure command signals and a pressure feedback signal) output from the pressure sensors 51 to 56 and the pilot pressure sensor 45. Hereinafter, the configuration of the control unit 60 will be explained in more detail.

Figure 3:
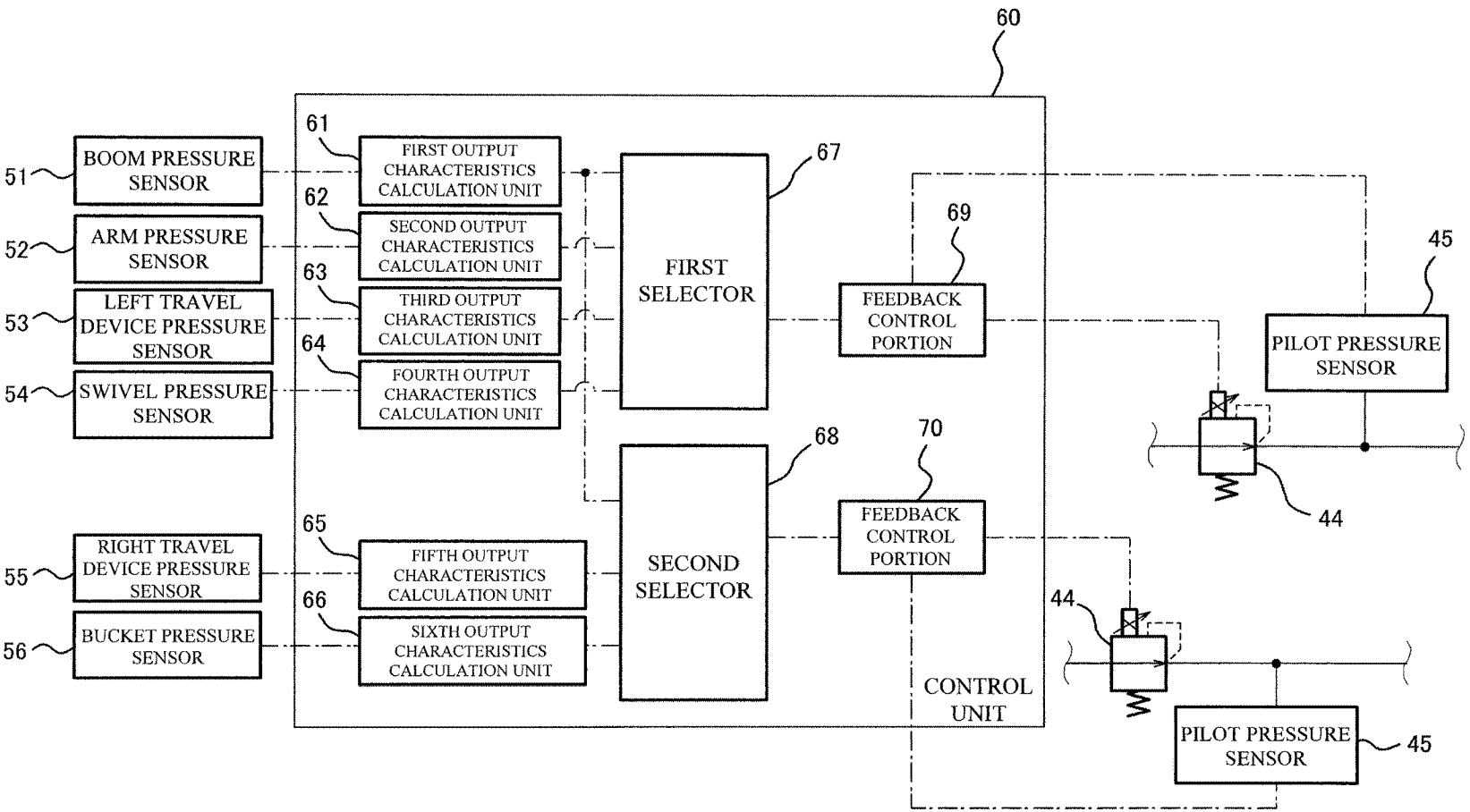
FIG. 3 is a block diagram showing the configuration of a control unit shown in FIG. 2 or 7.

As shown in FIG. 3, the control unit 60 includes output characteristics calculation units 61 to 66. The output characteristics calculation units 61 to 66 respectively correspond to the pressure sensors 51 to 56. Each of the output characteristics calculation units 61 to 66 stores an output characteristic that is a correspondence relationship between the pressure command signal from the corresponding pressure sensor 51, 52, 53, 54, 55, or 56 and output pressure of the electromagnetic proportional control valve 44. Regarding the output characteristics, for example, the output pressure of the electromagnetic proportional control valve 44 is set such that the discharge amount of the hydraulic pump 10L with respect to the maximum operation amount becomes equal to or lower than an allowable maximum flow rate of each of the hydraulic actuators 3 to 6. With this, each of the hydraulic actuators 3 to 6 is prevented from being supplied with the operating oil, the flow rate of which is higher than the allowable maximum flow rate. Each of the calculation units 61 to 66 calculates an output pressure signal of the electromagnetic proportional control valve 44 based on the pressure command signal of the corresponding pressure sensor 51, 52, 53, 54, 55, or 56 and the output characteristic. The calculation units 61 to 66 are connected to first and second selectors 67 and 68 and output the obtained output pressure signals to the first and second selectors 67 and 68.

Figure 4A:
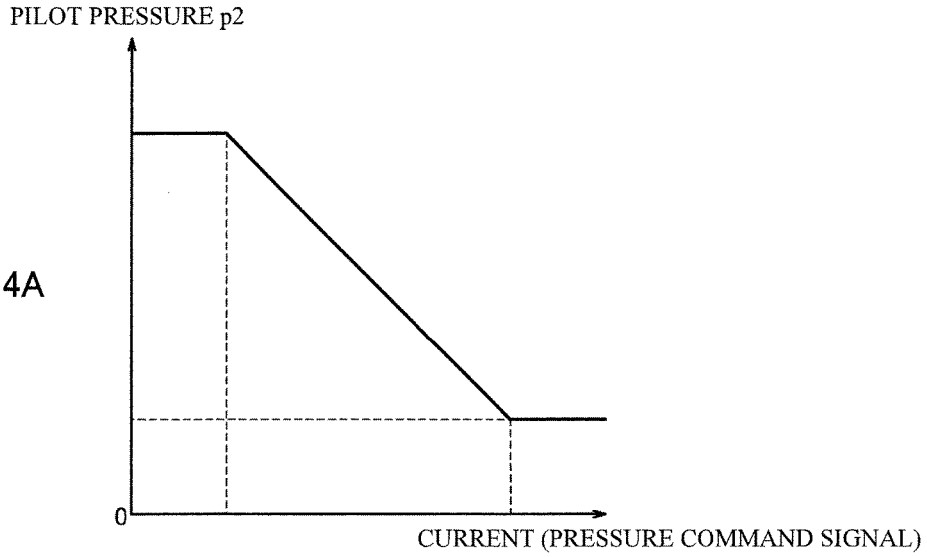
FIG. 4A is a graph showing an output characteristic with respect to a work operation valve of FIG. 2.
Figure 4B:
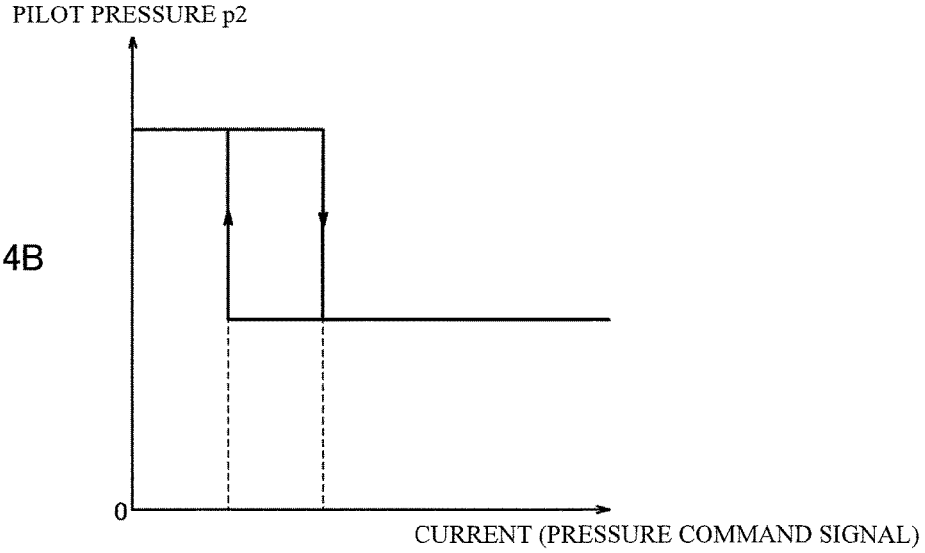
FIG. 4B is a graph showing the output characteristic with respect to a travel operation valve of FIG. 2.

Specifically, for example, the first output characteristics calculation unit 61 corresponding to the boom pressure sensor 51 is connected to the first selector 67 and the second selector 68 and outputs the obtained output pressure signal to these two selectors 67 and 68. Each of the second to fourth output characteristics calculation units 62 to 64 respectively corresponding to the arm pressure sensor 52, the left travel device pressure sensor 53, and the swivel pressure sensor 54 is connected to the first selector 67 and outputs the obtained output pressure signal to the first selector 67. Further, each of the fifth and sixth output characteristics calculation units 65 and 66 respectively corresponding to the right travel device pressure sensor 55 and the bucket pressure sensor 56 is connected to the second selector 68 and outputs the obtained output pressure signal to the second selector 68. As each of the output characteristics of the first to sixth output characteristics calculation units 61 to 66, the output characteristic in which the pressure command signal and the pilot pressure p2 are inversely proportional to each other as shown in FIG. 4A, the output characteristic in which the pilot pressure p2 with respect to the pressure command signal changes stepwisely and has hysteresis, or the like is suitably selected.

Figure 6:
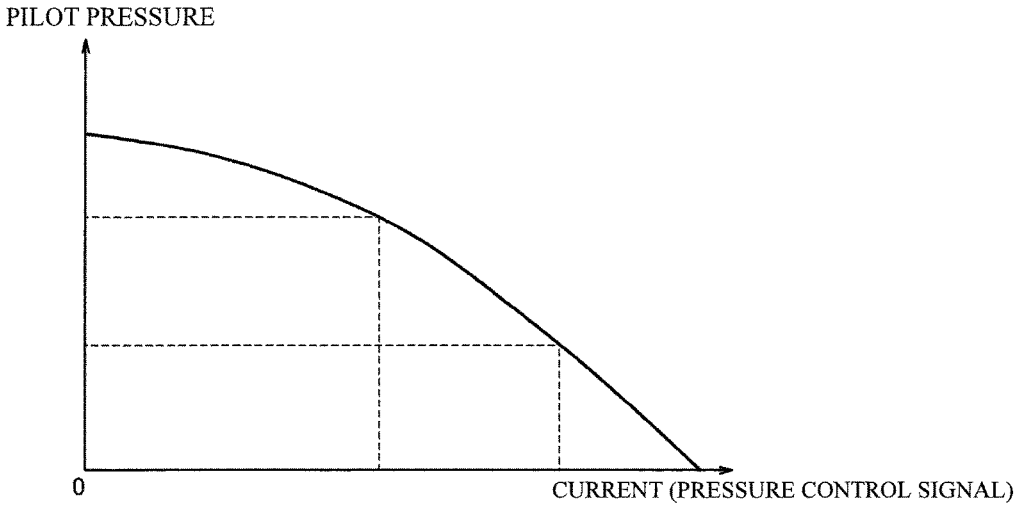
FIG. 6 is a graph showing a valve characteristic that is a relationship between an input current value of an electromagnetic proportional control valve of FIG. 2 and pilot pressure to be output.

The first selector 67 has a function of selecting any one of the output pressure signals input to the first selector 67. More specifically, the first selector 67 selects, out of a plurality of output pressure signals input to the first selector 67, the output pressure signal by which the discharge amount of the hydraulic pump 10L becomes the largest. In the present embodiment, as shown in FIG. 6, the output characteristic of the electromagnetic proportional control valve 44 is non-linear and has an inversely proportional relationship in which the output pressure (pilot pressure) decreases as the input current value (pressure control signal) increases. Therefore, the first selector 67 selects the smallest one out of a plurality of output pressure signals input to the first selector 67. The second selector 68 has a function of selecting the smallest one out of a plurality of output pressure signals input to the second selector 68. The first selector 67 outputs the selected output pressure signal to a first feedback controller 69, and the second selector 68 outputs the selected output pressure signal to a second feedback controller 70. The second feedback controller 70 is the same in configuration as the first feedback controller 69, so that an explanation of the configuration thereof is omitted.

Figure 5:
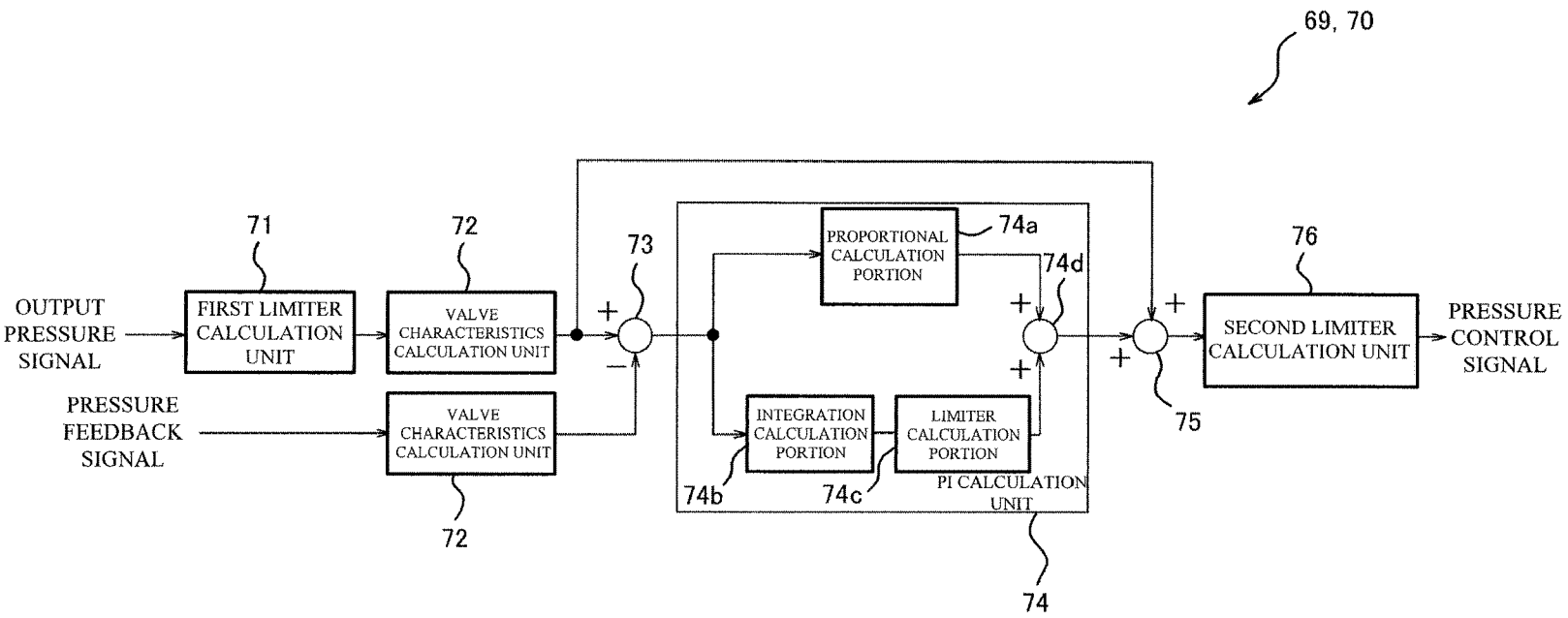
FIG. 5 is a block diagram showing control operations executed by the control unit shown in FIG. 2 or 7.

As shown in FIG. 5, the first feedback controller 69 includes a first limiter calculation unit 71. The selected output pressure signal output from the first selector 67 is input to the first limiter calculation unit 71. The first limiter calculation unit 71 has a function of determining whether or not the output pressure signal input to the first limiter calculation unit 71 is lower than predetermined pressure. Further, the first limiter calculation portion 71 has such a limiter function that: when the output pressure signal input to the first limiter calculation portion 71 is lower than the predetermined pressure, the first limiter calculation portion 71 outputs the output pressure signal as-is; and when the output pressure signal input to the first limiter calculation portion 71 is equal to or higher than the predetermined pressure, the first limiter calculation portion 71 outputs the output pressure signal that is a signal of the predetermined pressure. The first limiter calculation unit 71 having this function is connected to a valve characteristics calculation unit 72.

Based on the output pressure signal, the valve characteristics calculation unit 72 calculates a first current value to be supplied to the electromagnetic proportional control valve 44. Specifically, the valve characteristics calculation unit 72 stores a valve characteristic indicating a relationship between the current value input to the electromagnetic proportional control valve 44 and the pilot pressure output from the electromagnetic proportional control valve 44. The valve characteristics calculation unit 72 has a function of calculating, based on this valve characteristic and the output pressure signal input to the valve characteristics calculation unit 72, a command current value I1 (first current value) to be input to the electromagnetic proportional control valve 44.

The pilot pressure sensor 45 is connected to the valve characteristics calculation unit 72, and the pressure feedback signal that is the detection result of the pilot pressure sensor 45 is input to the valve characteristics calculation unit 72. Based on this pressure feedback signal and the valve characteristic, the valve characteristics calculation unit 72 calculates an actual current value I2 (second current value) that is a current value actually input to the electromagnetic proportional control valve 44. The valve characteristics calculation unit 72 configured as above is further connected to a deviation calculation unit 73 and outputs these two current values I1 and I2 to the deviation calculation unit 73.

The deviation calculation unit 73 has a function of subtracting the actual current value I2 from the command current value I1 to obtain a deviation ΔI. The deviation calculation unit 73 is connected to a PI calculation unit 74 and outputs the deviation ΔI to the PI calculation unit 74. The PI calculation unit 74 performs PI calculation and outputs the calculation result to an addition calculation unit 75. Specifically, the PI calculation unit 74 includes a proportional calculation portion 74*a*, an integration calculation portion 74*b*, a limiter calculation portion 74*c*, and an addition portion 74*d*, and the deviation ΔI is input to the proportional calculation portion 74*a* and the integration calculation portion 74*b*.

The proportional calculation portion 74*a* has a function of multiplying the deviation ΔI by a predetermined proportional gain Kp to obtain a proportional term. The integration calculation portion 74*b* has a function of multiplying an integrated value of the deviation ΔI by a predetermined integration gain Ki to obtain an integration term. The integration calculation portion 74*b* is connected to the limiter calculation portion 74*c* and outputs the obtained integration term to the limiter calculation portion 74*c*. The limiter calculation portion 74*c* has a function of determining whether or not the obtained integration term is smaller than a predetermined value. Further, the limiter calculation portion 74*c* has such a limiter function that: when the integration term is smaller than the predetermined value, the limiter calculation portion 74*c* outputs the integration term as-is; and when the integration term is equal to or larger than the predetermined value, the limiter calculation portion 74*c* outputs the integration term that is the predetermined value. The limiter calculation portion 74*c* and the proportional calculation portion 74*a* are connected to the addition portion 74*d* and output the calculation results to the addition portion 74*d*. The addition portion 74*d* has a function of adding the proportional term from the proportional calculation portion 74*a* and the integration term from the limiter calculation portion 74*c*. To be specific, the PI calculation portion 74 adds the proportional term and the integration term to obtain a PI calculation value (control calculation value). The addition portion 74*d* is connected to the addition calculation unit 75 and outputs the PI calculation value to the addition calculation unit 75.

The valve characteristics calculation unit 72 is further connected to the addition calculation unit 75 and outputs the command current value I1 to the addition calculation unit 75. The addition calculation unit 75 has a function of adding the PI calculation value to the command current value I1 to obtain the pressure control signal. Further, the addition calculation unit 75 is connected to a second limiter calculation unit 76 and outputs the pressure control signal to the second limiter calculation unit 76. The second limiter calculation unit 76 has a function of determining whether or not the pressure control signal is smaller than a predetermined current value. Further, the second limiter calculation unit 76 has such a function that: when the pressure control signal is smaller than the predetermined current value, the second limiter calculation unit 76 outputs the pressure control signal as-is; and when the pressure control signal is equal to or higher than the predetermined current value, the second limiter calculation unit 76 outputs the pressure control signal that is a signal of the predetermined current value. The second limiter calculation unit 76 is connected to the electromagnetic proportional control valve 44 and outputs the pressure control signal to the electromagnetic proportional control valve 44.

Operations of Tilting Angle Control Device

According to the tilting angle control device 1 configured as above, when the operation lever 21*a* or the operation pedal 22*a* or 22*b* is operated, and the pilot pressure is output from the operation valve 21 or 22, the pressure sensor 51, 52, 53, 54, 55, or 56 detects the pilot pressure. The pressure sensors 51, 52, 53, 54, 55, or 56 outputs the detected pilot pressure as the pressure command signal to the control unit 60. As shown in FIG. 5, the control unit 60 includes the feedback controllers 69 and 70 as described above. The electromagnetic proportional control valve 44 outputs to the second pilot passage 43 the pilot pressure p2 corresponding to the pressure control signal calculated by the feedback controller 69 or 70.

The output pilot pressure p2 is detected by the pilot pressure sensor 45, and the pilot pressure sensor 45 outputs the detection result as the pressure feedback signal to the control unit 60. Based on the pressure feedback signal and the pressure command signal and in view of the characteristics of the electromagnetic proportional control valve 44, the control unit 60 performs the feedback control of the pilot pressure p2, specifically, the PI control of the pilot pressure p2, as described above. The pilot pressure p2 having been subjected to the PI control is introduced to the shuttle valve 42. The shuttle valve 42 selects a higher one out of the pilot pressure p2 and the negative control pressure p1 of the first pilot passage 41 branching from the connecting point 32 of a center bypass passage, and the selected pilot pressure is introduced to the tilt adjustment mechanism 31. In the tilt adjustment mechanism 31, the servo piston moves in accordance with the movement of the pilot piston 31*a* by the introduced pilot pressure, and the swash plate 10*b* tilts at the tilting angle α corresponding to the pilot pressure.

Specifically, when the operation valve 21 or 22 is operated in order to drive any one of the hydraulic actuators 3 to 9, the tank passage 18 is blocked by any one of the control valves 13 to 16, so that the negative control pressure p1 decreases. The pilot pressure p2 is output in accordance with the operation amount of the operation valve 21 or 22 and decreases as with the negative control pressure p1. However, the pilot pressure p2 is calculated based on the output characteristic for each actuator, so that the pilot pressure p2 can be preset to high pressure in accordance with the required flow rate of the actuator. Therefore, the pilot pressure p2 is selected by the shuttle valve 42 to be introduced to the pressure chamber 31*b* of the tilt adjustment mechanism 31. In the tilt adjustment mechanism 31, the pilot piston 31*a* receives the pilot pressure p2 to move, and the swash plate 10*b* tilts at an angle corresponding to the pilot pressure p2 via the servo piston. To be specific, the swash plate 10*b* tilts at an angle corresponding to the operation amount of the operation valve 21 or 22 that requires the highest flow rate, and the required minimum flow rate is obtained for each actuator.

When the operation valves 21 and 22 are not operated, the connecting point 32 is connected to the hydraulic pump 10L or 10R through the tank passage 18. Therefore, the pressure increases at the connecting point 32, and the negative control pressure p1 corresponding to the discharge pressure of the hydraulic pump 10L or 10R is introduced to the shuttle valve 42. On the other hand, since the operation valves 21 and 22 are not operated, the pilot pressure p2 becomes substantially equal to the pressure of a pilot pressure source, not shown, and becomes the maximum value. Therefore, the shuttle valve 42 introduces higher pressure out of the negative control pressure p1 and the pilot pressure p2 to the pressure chamber 31*b* of the tilt adjustment mechanism 31. When the tilt adjustment mechanism 31 receives the higher pressure, the servo piston moves via the pilot piston 31*a*, and the swash plate 10*b* tilts at an angle corresponding to the higher pilot pressure. To be specific, when the higher pilot pressure is received, the swash plate 10*b* tilts so as to rise (so as to decrease the tilting angle α). Thus, the discharge flow rate of the hydraulic pump 10L or 10R decreases.

As above, in the tilting angle control device 1, the pilot pressure p2 output from the electromagnetic proportional control valve 44 and the pressure command signal are set as one-to-one correspondence by the output characteristic, and the feedback control of the pilot pressure p2 is performed based on the pressure feedback signal that is the detection result of the pilot pressure sensor 45. Therefore, the output accuracy of the pilot pressure p2 with respect to the pressure command signal improves. Since the pilot pressure p2 whose output accuracy with respect to the pressure command signal is high is introduced to the pressure chamber 31*b* of the tilt adjustment mechanism 31, the positional accuracy of the inclination angle α of the swash plate 10*b* with respect to the operation amount of the operation valve 21 or 22 improves, and the discharge flow rates of the hydraulic pumps 10L and 10R can be accurately controlled with respect to the operation amounts of the operation valves 21 and 22. With this, the operating oil, the flow rate of which is equal to or higher than the allowable maximum flow rate, can prevented from being discharged from each of the hydraulic pumps 10L and 10R, and the control can be performed at the required minimum discharge flow rate. Thus, while preventing the hydraulic actuators 3 to 9 from being damaged, each of the hydraulic actuators 3 to 9 can be operated at each maximum speed by the required minimum discharge flow rate.

In the tilting angle control device 1, the PI control of the pilot pressure p2 is performed by the deviation calculation unit 73 and the PI calculation unit 74. With this, the pilot pressure p2 becomes stable and can quickly converge to the target value. Thus, the responsiveness of the discharge flow rate of each of the hydraulic pumps 10L and 10R can be improved.

Further, each of the electromagnetic proportional control valves 44 has a non-linear valve characteristic. Even the same electromagnetic proportional control valves respectively have different valve characteristics. In the tilting angle control device 1, the valve characteristics calculation unit 72 calculates based on the valve characteristic of the electromagnetic proportional control valve 44 a current value I3 to be supplied with respect to the pilot pressure p2 to be output. With this, the output accuracy of the pilot pressure p2 with respect to the pressure command signal can be further improved, and the discharge amounts of the hydraulic pumps 10L and 10R can be accurately controlled with respect to the operation amounts of the operation valves 21 and 22.

In the tilting angle control device 1, in a case where a plurality of operation valves 21 and 22 are operated at the same time, the control unit 60 causes the selectors 67 and 68 to determine the pressure command signal that requires the highest flow rate. Then, the control unit 60 controls the pilot pressure p2 in accordance with the pressure command signal by the feedback controllers 69 and 70. As above, since each of the discharge amounts of the hydraulic pumps 10L and 10R is adjusted in accordance with the required maximum flow rate, the operating oil, the flow rate of which corresponds to the operation amounts, can be introduced to the hydraulic actuators 3 to 9. With this, even in a case where a plurality of operation valves 21 and 22 are operated at the same time, each of the hydraulic actuators 3 to 9 can be operated at a speed corresponding to the operation amounts.

Embodiment 2

The tilting angle control device 1A of Embodiment 2 of the present invention is similar in configuration to the tilting angle control device 1 of Embodiment 1. Therefore, regarding the configuration of the tilting angle control device 1A of Embodiment 2, points different from the configuration of the tilting angle control device 1 of Embodiment 1 will be mainly explained. The same reference signs are used for the same components, and a repetition of the same explanation is avoided. The same is true for the tilting angle control device 1B of Embodiment 3 explained later.

Figure 7:
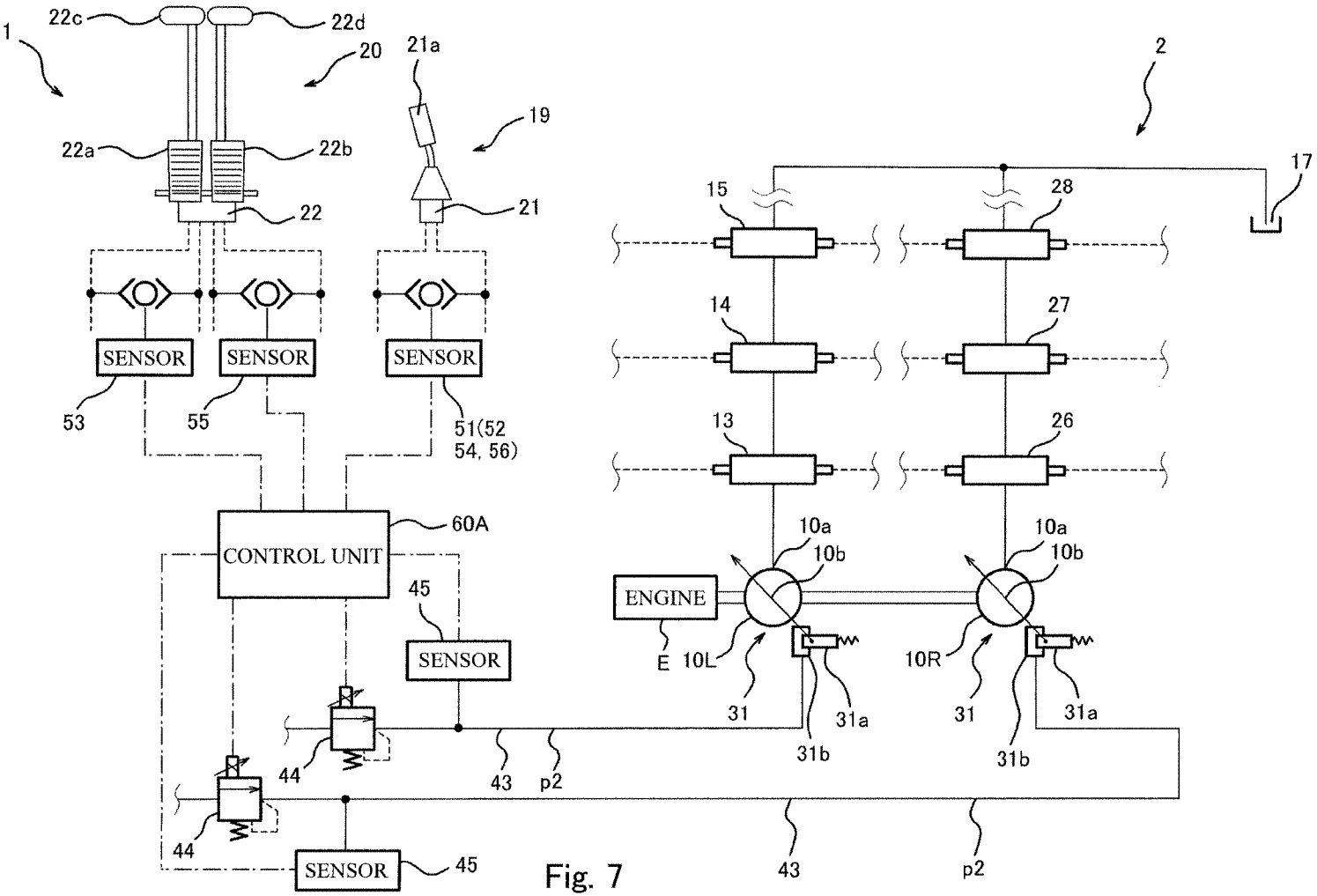
FIG. 7 is a block diagram showing control operations executed by the control unit of the tilting angle control device according to Embodiment 2.

As shown in FIG. 7, the tilting angle control device 1A of Embodiment 2 controls the discharge amounts of the hydraulic pumps 10L and 10R by a positive control method. In the positive control method, because of the reasons described below, it is desirable that the electromagnetic proportional control valve 44 be a direct proportional valve. In the tilting angle control device 1A, the pilot pressure p2 is introduced to the pressure chamber 31*b* of the tilt adjustment mechanism 31, and the swash plate 10*b* tilts at an angle corresponding to the pilot pressure p2. With this, the discharge flow rate of the hydraulic pump 10L (or the hydraulic pump 10R) is adjusted. In the positive control method, when the pilot pressure p2 is high, the discharge flow rate of the hydraulic pump 10L (or the hydraulic pump 10R) becomes high.

The tilting angle control device 1A includes a control unit 60A. As with Embodiment 1, the tilting angle control device 1A calculates the pressure control signal by the feedback controllers 69 and 70 as shown in FIG. 5. The electromagnetic proportional control valve 44 outputs to the second pilot passage 43 the pilot pressure p2 corresponding to the pressure control signal calculated by the feedback controller 69 or 70.

The pilot pressure sensor 45 detects the output pilot pressure p2 at the second pilot passage 43 and outputs the detection result as the pressure feedback signal to the control unit 60A. Based on the pressure feedback signal and the pressure command signal, the control unit 60A performs the feedback control of the pilot pressure p2, specifically, the PI control of the pilot pressure p2, as described above. In accordance with the pilot pressure p2 having been subjected to the PI control, the servo piston moves via the pilot piston 31*a* of the tilt adjustment mechanism 31, and the swash plate 10*b* is located at the tilting angle $\alpha$. With this, each of the hydraulic pumps 10L and 10R can discharge the operating oil, the discharge amount of which corresponds to the pressure command signal (the largest output pressure signal is selected in a case where a plurality of pressure command signals are input), that is, the discharge flow rate of which corresponds to the operation amount (the largest operation amount is selected in a case where a plurality of operation valves 21 and 22 are operated) of the operation valve 21 or 22.

Figure 9:
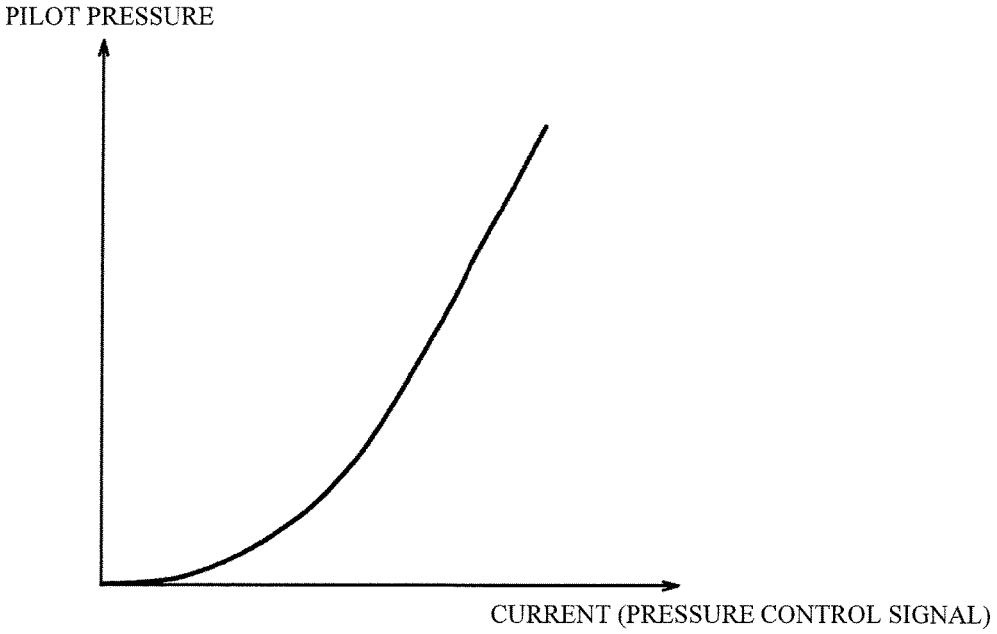
FIG. 9 is a graph showing a valve characteristic that is a relationship between the input current value of the electromagnetic proportional control valve of FIG. 7 and the pilot pressure to be output.

In order to control the discharge flow rate by the positive control method, the tilting angle control device 1A uses the electromagnetic proportional control valves 44 that are the direct proportional valves. As shown in FIG. 9, the valve characteristic of each of the electromagnetic proportional control valves 44 that are the direct proportional valves is non-linear and has a relationship in which the output pressure (pilot pressure) increases as the input current value (pressure control signal) increases. A merit obtained by utilizing the electromagnetic proportional control valves 44 that are the direct proportional valves is as below. That is, in a case where power cannot be supplied to the electromagnetic valve due to, for example, the malfunction of an electric system, the minimum pressure is output, and the pump tilt becomes minimum, that is, the flow rate becomes minimum. On this account, the actuator speed decreases. Thus, the fail-safe is realized.

Figure 10A:
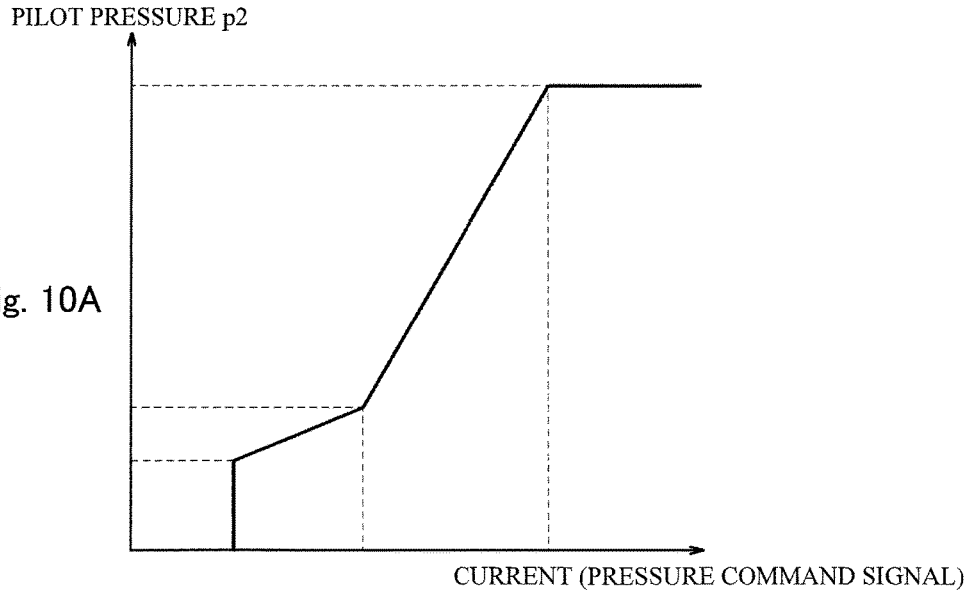
FIG. 10A is a graph showing the output characteristic with respect to the work operation valve of FIG. 7.
Figure 10B:
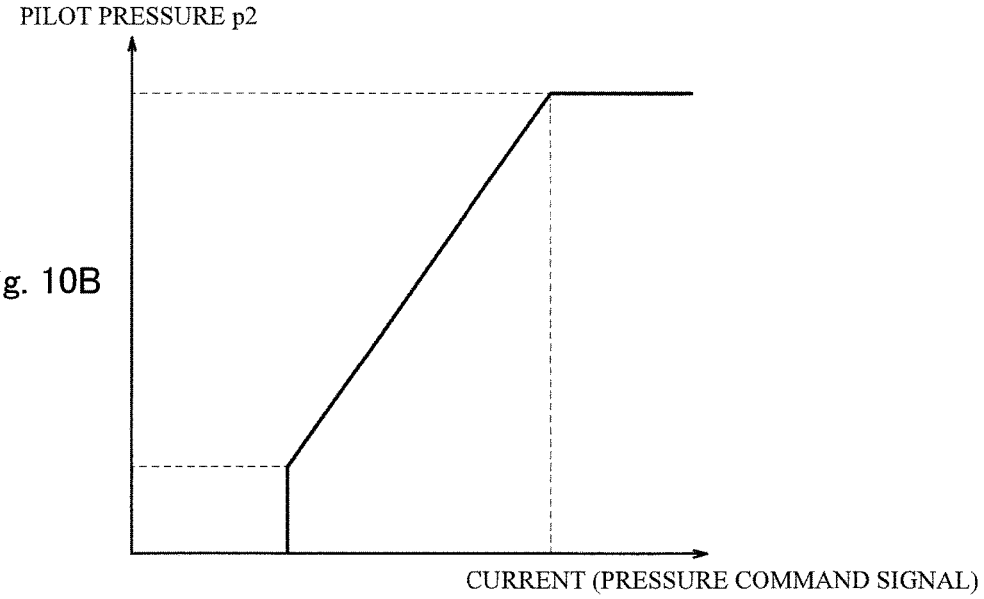
FIG. 10B is a graph showing the output characteristic with respect to the travel operation valve of FIG. 7.

Since the control unit 60A adopts the electromagnetic proportional control valves 44, the output characteristic of each of the output characteristics calculation units 61 to 65 is set as any one of the output characteristics shown in FIGS. 10A and 10B. In FIG. 10A, the pressure command signal and the pilot pressure p2 are directly proportional to each other. In FIG. 10B, the pilot pressure p2 is directly proportional to the pressure command signal and changes stepwisely with respect to the pressure command signal.

The tilting angle control device 1A configured as above has the same operational advantages as the tilting angle control device 1 of Embodiment 1.

Embodiment 3

Figure 8:
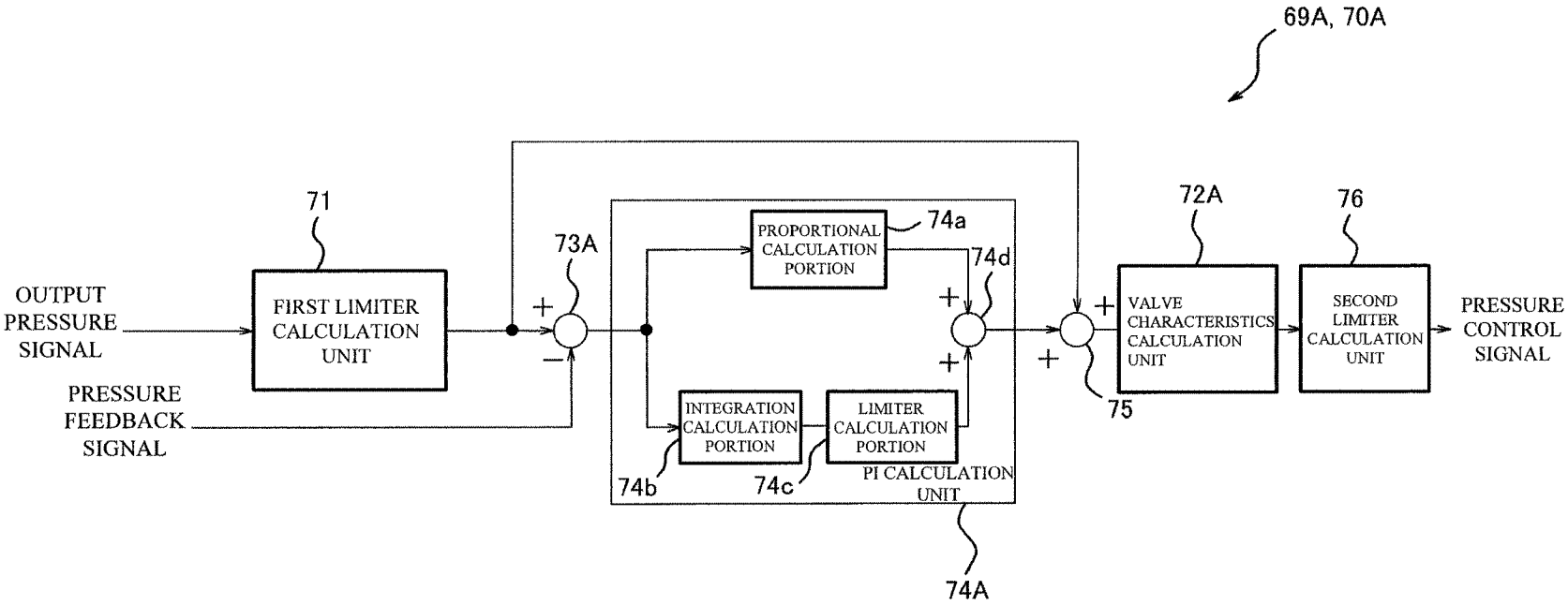
FIG. 8 is a block diagram showing the control operations executed by the control unit shown in FIG. 2 or 7.

As shown in FIG. 8, each of the control units 60 and 60A of the tilting angle control devices 1 and 1A includes feedback controllers 69A and 70A. In each of the feedback controllers 69A and 70A, the output pressure signal output from the first limiter calculation unit 71 and the pressure feedback signal output from the pilot pressure sensor 45 are input to a deviation calculation unit 73A without passing through the valve characteristics calculation unit 72, and the deviation calculation unit 73A calculates a deviation Δp between the output pressure signal and the pressure feedback signal. A PI calculation unit 74A performs PI calculation of the deviation Δp to obtain a PI calculation value and outputs the obtained PI calculation value to the addition calculation unit 75.

The first limiter calculation unit 71 is directly connected to the addition calculation unit 75 in addition to the deviation calculation unit 73A and outputs the output pressure signal to the addition calculation unit 75. The addition calculation unit 75 adds the PI calculation value to the output pressure signal. A valve characteristics calculation unit 72A has a function of calculating the pressure control signal based on an addition calculation value obtained by the addition calculation unit 75 and the valve characteristic. The obtained pressure control signal is input to the second limiter calculation unit 76. The second limiter calculation unit 76 limits the pressure control signal such that the pressure control signal becomes equal to or smaller than a predetermined current value. Then, the second limiter calculation unit 76 outputs the pressure control signal to the electromagnetic proportional control valve 44. The electromagnetic proportional control valve 44 outputs to the second pilot passage 43 the pilot pressure p2 corresponding to the pressure control signal.

According to the present embodiment, in the control unit 60, the electromagnetic proportional control valve 44 is an inverse proportional valve configured such that the output pressure increases as the input current value decreases, and the valve characteristic of the electromagnetic proportional control valve 44 is non-linear as shown in FIG. 6. In the control unit 60A, the electromagnetic proportional control valve 44 is a direct proportional valve configured such that the output pressure increases as the input current value increases, and the valve characteristic of the electromagnetic proportional control valve 44 is non-linear as shown in FIG. 9. A merit obtained by using the inverse proportional valve as the electromagnetic proportional control valve 44 in the negative control method and using the direct proportional valve as the electromagnetic proportional control valve 44 in the positive control method is as below. That is, in a case where power cannot be supplied to the electromagnetic valve due to, for example, the malfunction of an electric system, the maximum pressure is output, and the pump tilt becomes minimum, that is, the flow rate becomes minimum. On this account, the actuator speed decreases. Thus, the fail-safe is realized.

In addition, the tilting angle control device 1B of Embodiment 3 has the same operational advantages as the tilting angle control device 1 of Embodiment 1.

Other Embodiments

In Embodiments 1 and 2, the PI control of the pilot pressure p2 is performed. However, PID control may be performed. The inverse proportional valve is adopted as the electromagnetic proportional control valve in the negative control method of Embodiment 1, and the direct proportional valve is adopted as the electromagnetic proportional control valve in the positive control method of Embodiment 2. However, the present invention is not limited to this.

In Embodiments 1 and 2, the electromagnetic proportional control valve 44 is used as a valve configured to adjust the pilot pressure p2. However, the electromagnetic proportional control valve does not have to be an electromagnetic proportional pressure reducing valve. For example, the electromagnetic proportional control valve may be an electromagnetic proportional relief valve, a proportional control valve driven by a force motor, or a proportional control valve driven by a piezoelectric element.

From the foregoing explanation, many modifications and other embodiments of the present invention are obvious to one skilled in the art. Therefore, the foregoing explanation should be interpreted only as an example and is provided for the purpose of teaching the best mode for carrying out the present invention to one skilled in the art. The structures and/or functional details may be substantially modified within the spirit of the present invention.

REFERENCE SIGNS LIST

1 tilting angle control device
3 boom cylinder
4 arm cylinder
5 left travel motor
6 swivel motor
7 right travel motor
8 bucket cylinder
9 boom cylinder
10*b* swash plate
10L, 10R hydraulic pump
21 operation valve
21*a* operation lever
22 travel operation valve
22*a* operation pedal
31 tilt adjustment mechanism
42 shuttle valve
44 electromagnetic proportional control valve
45 pilot pressure sensor
51 boom pressure sensor
52 arm pressure sensor
53 left travel device pressure sensor
54 swivel pressure sensor
55 right travel device pressure sensor
56 bucket pressure sensor
60 control unit
61 to 66 first to sixth output characteristics calculation units
67 first selector
68 second selector
72 valve characteristics calculation unit
73 deviation calculation unit
74 PI calculation unit
75 addition calculation unit

The invention claimed is:

1. A tilting angle control device configured to control a tilting angle of a variable displacement pump configured to discharge a pressure liquid, the amount of which corresponds to the tilting angle, the tilting angle control device comprising:

an operation unit configured to output a pressure command signal corresponding to an operation amount of the operation unit, in order to drive an actuator;

a control unit configured to output a pressure control signal corresponding to the pressure command signal;

a proportional control valve configured to output pilot pressure corresponding to the pressure control signal;

a tilt adjustment mechanism configured to adjust the tilting angle of the variable displacement pump such that the tilting angle becomes an angle corresponding to the pilot pressure; and a pressure detector configured to detect the pilot pressure to output to the control unit a pressure feedback signal corresponding to the detected pilot pressure, wherein:

the control unit calculates the pressure control signal based on the pressure feedback signal and the pressure command signal, the proportional control valve has a valve characteristic of outputting predetermined pilot pressure corresponding to a pressure control signal input to the proportional control valve;

the valve characteristic of the proportional control valve and valve characteristics of other proportional control valves, each of which is the same type of proportional control valve, are different from one another; and the control unit stores the valve characteristic and calculates the pressure control signal based on the pressure feedback signal, the pressure command signal, and the valve characteristic.

2. The tilting angle control device according to claim 1, wherein:

the control unit includes an output characteristics calculation unit configured to store an output characteristic indicating the pilot pressure to be output from the proportional control valve in accordance with the pressure command signal and configured to calculate an output pressure signal based on the pressure command signal from the operation unit and the output characteristic, and a feedback control portion configured to calculate the pressure control signal based on the valve characteristic, the feedback signal, and the output pressure signal; and the output characteristic indicates the pilot pressure that is set in consideration of an operation characteristic of the actuator and is to be output in accordance with the pressure command signal.

3. The tilting angle control device according to claim 2, wherein the feedback control portion includes:

a valve characteristics calculation unit configured to calculate a first current value based on the valve characteristic and the output pressure signal;

a control calculation unit configured to perform control calculation of a deviation between the first current value and the pressure feedback signal to obtain a control calculation value; and an addition calculation unit configured to add the first current value and the control calculation value to obtain the pressure control signal and output the pressure control signal to the proportional control valve.

4. The tilting angle control device according to claim 2, wherein the feedback control portion includes:

a valve characteristics calculation unit configured to calculate a first current value based on the valve characteristic and the output pressure signal;

a valve characteristics calculation unit configured to calculate a second current value based on the valve characteristic and the pressure feedback signal;

a control calculation unit configured to perform control calculation of a deviation between the first current value and the second current value to obtain a control calculation value; and an addition calculation unit configured to add the first current value and the control calculation value to obtain the pressure control signal and output the pressure control signal to the proportional control valve.

5. The tilting angle control device according to claim 2, wherein the feedback control portion includes:

a control calculation unit configured to perform control calculation of a deviation between the output pressure signal and the pressure feedback signal to obtain a control calculation value;

an addition calculation unit configured to add the output pressure signal and the control calculation value to obtain an addition calculation value; and a valve characteristics calculation unit configured to calculate the pressure control signal based on the valve characteristic and the addition calculation value and output the pressure control signal to the proportional control valve.

6. The tilting angle control device according to claim 2, wherein:

the operation unit is one of a plurality of operation units respectively provided for a plurality of actuators; and the control unit includes the output characteristics calculation unit provided for each of the operation units, and a selector configured to select the output pressure signal by which a discharge amount of the variable displacement pump becomes the largest, out of a plurality of output pressure signals calculated by the output characteristics calculation units.

7. The tilting angle control device according to claim 2, wherein:

the tilting angle control device uses a negative control method;

the tilting angle control device further comprises control valves each configured to operate in accordance with an operation of the operation unit to control a flow rate of the pressure liquid flowing to the actuator;

the operation unit is one of a plurality of operation units respectively provided for a plurality of actuators;

spools of the control valves are respectively provided for the plurality of actuators;

the control unit includes the output characteristics calculation unit provided for each of the operation units, a selector configured to select the output pressure signal by which a discharge amount of the variable displacement pump becomes the largest, out of a plurality of output pressure signals calculated by the output characteristics calculation units, and a selective mechanism configured to select, based on the output pressure signal selected by the selector, pressure by which the discharge amount of the variable displacement pump becomes small, out of the pilot pressure output from the proportional control valve and negative control pressure at a negative control passage branching from an extreme downstream of the spool of the control valve; and the tilt adjustment mechanism adjusts the tilting angle of the variable displacement pump such that the tilting angle becomes an angle corresponding to the pressure selected by the selective mechanism.

8. The tilting angle control device according to claim 1, wherein:

the tilting angle control device uses a negative control method; and the proportional control valve is an inverse proportional valve.

9. The tilting angle control device according to claim 1, wherein:

the tilting angle control device uses a positive control method; and the proportional control valve is a direct proportional valve.

* * * * *